US006506046B1

(12) United States Patent
Luo

(10) Patent No.: US 6,506,046 B1
(45) Date of Patent: Jan. 14, 2003

(54) PIEZOELECTRIC LIGHTER WITH SAFETY ARRANGEMENT

(75) Inventor: Ying Wen Luo, Alhambra, CA (US)

(73) Assignee: Zhuoye Lighter (USA) Ltd., Alhambra, CA (US)

( * ) Notice: Subject to any disclaimer, the term of this patent is extended or adjusted under 35 U.S.C. 154(b) by 0 days.

(21) Appl. No.: 09/971,888

(22) Filed: Oct. 4, 2001

(51) Int. Cl.[7] ..... F23D 11/36
(52) U.S. Cl. ..... 431/153; 431/255
(58) Field of Search ..... 431/153, 255, 431/277, 254, 276, 344

(56) References Cited

U.S. PATENT DOCUMENTS 5,145,358 A * 9/1992 Shike et al. ..... 431/277
5,662,466 A * 9/1997 Cheng ..... 431/255
5,829,963 A * 11/1998 Ichikawa ..... 431/254
6,287,109 B1 * 9/2001 Hirota ..... 431/254

* cited by examiner

*Primary Examiner*—James C. Yeung
(74) *Attorney, Agent, or Firm*—Raymond Y. Chan; David & Raymond Patent Group

(57) ABSTRACT

A piezoelectric lighter incorporates with a safety arrangement which includes is movably mounted on a casing in a vertical movable manner wherein a guiding slot is provided on top of the casing to communicate with an exterior thereof. A locking member includes a locking arm disposed in the ignition cavity and an operation button slidably mounted on an ignition button. A resilient element is adapted for applying an urging pressure against the locking arm so as to normally retain the locking arm in a locking position. In which, in the locking position, the locking arm blocks up the ignition button from ignition. In order to ignite the piezoelectric lighter, a user's thumb must operate the operation button for moving the locking arm to an unlocking position. Then, the user is able to push the ignition button downwardly to ignite the piezoelectric lighter.

11 Claims, 8 Drawing Sheets

PIEZOELECTRIC LIGHTER WITH SAFETY ARRANGEMENT

BACKGROUND OF THE PRESENT INVENTION

1. Field of Invention

The present invention relates to a piezoelectric lighter, and more particularly to a piezoelectric lighter with safety arrangement which normally locks up the ignition button of the piezoelectric lighter so as to prevent the piezoelectric lighter from ignited accidentally or by children.

2. Description of Related Arts

Commercially available piezoelectric lighters are dangerous if they are handled. careless, especially by young children. The inadvertent ignition of such piezoelectric lighters may result in fires causing property damage and injury to people. Therefore, there is a need for a safety device that prevents inadvertent ignition of the disposable lighter, or makes the lighters difficult for children to operate.

In response to the demands for the piezoelectric lighter which is improved in safety in such a manner that inadvertent and unintentional ignition by those who are unfamiliar with the proper use of the lighter can surely be prevented. An improved piezoelectric lighter having different types of safety devices have already been known. The piezoelectric lighter generally comprises a cap which covers on top of the lighter. In order to ignite the lighter, a user must open the cap and downwardly depress an ignition button. The cap can prevent the lighter from being ignited accidentally. However, it cannot stop children from the usage of the piezoelectric lighter.

The piezoelectric lighter with another type of safety device have lock mechanism which prevents depression of the depressible operation button and must be released to allow the operation button to be depressed. However, the original structural design of piezoelectric lighter must be altered to incorporate with the lock mechanism.

Therefore, in manufacturing lighters with such a safety device, it is required to rationalize the assembling steps, to improve assembling accuracy, thereby further enhancing the handling of the safety device, and to reduce the manufacturing cost.

SUMMARY OF THE PRESENT INVENTION

A main object of the present invention is to provide a piezoelectric lighter with safety arrangement which can prevent the lighter from being ignited accidentally or by children.

Another object of the present invention is to provide a piezoelectric lighter with safety arrangement that normally locks up the downward movement of the ignition button of the piezoelectric lighter so as to prevent any unwanted ignition of the lighter.

Another object of the present invention is to provide a piezoelectric lighter with safety arrangement, wherein in order to depress the ignition button so as to ignite the lighter, a locking member of the safety arrangement must be manipulated and remained in an unlocked position. Therefore, children under five years old are unable to complete the ignition operation.

Another object of the present invention is to provide a piezoelectric lighter with safety arrangement, which not only normally retains in a locked condition but also automatically return to the locked condition after each ignition operation so as to prevent any unintentional ignition of the lighter.

Another object of the present invention is to provide a piezoelectric lighter with safety arrangement, wherein the ignition of the ignition of the lighter of the present invention requires a simple single-action operation by an adult's thumb instead of the conventional double-action operation.

Another object of the present invention is to provide a piezoelectric lighter with safety arrangement, which is adapted to be installed to all kinds of the lighter having the piezoelectric unit.

Another object of the present invention is to provide a piezoelectric lighter with safety arrangement, which does not require to alter the original structural design of the piezoelectric lighter, so as to minimize the manufacturing cost of incorporating the safety device with every conventional piezoelectric lighter having a conventional piezoelectric unit.

Accordingly, in order to accomplish the above objects, the present invention provides a piezoelectric lighter, comprising:

- a casing receiving a liquefied gas storage and an ignition cavity provided therein;
- a gas emitting nozzle disposed in the casing and communicating with the liquefied gas storage for controlling a flow of gas;
- a piezoelectric unit for generating piezoelectricity comprising a piezoelectric body having a ceiling disposed in the casing, a movable operating part upwardly extended from the piezoelectric body, and an ignition tip extended to a position close to the gas emitting nozzle, wherein when the movable operating part is depressed downwardly with respect to the piezoelectric body, the ignition tip generates sparks to ignite the gas emitted from the gas emitting nozzle; and
- a safety arrangement, comprising:
  - an ignition button movably mounted on the casing in a vertical movable mariner wherein the ignition button is attached to a top end of the piezoelectric unit and arranged in such a manner that when the ignition button is pushed downwardly, the movable operating part of the piezoelectric unit is depressed to ignite the piezoelectric lighter, wherein the ignition button has a guiding slot provided on a top portion thereof to communicate with outside;
  - a locking member comprising a locking arm disposed in the ignition cavity of the casing and arranged to bias against the ceiling of the piezoelectric body for blocking up the ignition button from being depressed downwardly so as to lock up the ignition button from ignition and an operation button slidably mounted on the ignition button and arranged to operate the locking arm to move from a normally locking position to an unlocking position; and
  - a resilient element which is disposed in the ignition cavity for applying an urging pressure against the locking member so as to normally retain the locking member in the locking position, wherein at the locking position, the ignition button is locked for downward movement by the locking member so as to prevent ignition, and that in the unlocking position, the locking member is moved to release the blocking up of the ignition button with respect to the piezoelectric unit, so that the ignition button is capable of being depressed downwardly to ignite the piezoelectric lighter.

In order to ignite the piezoelectric lighter, a pulling force must be intentionally applied to pull the operation button of the locking member rearwardly so as to move the bottom end of the locking arm away from the ceiling of the piezoelectric body of the piezoelectric unit to unlock the safety arrangement. At this unlocked position, a downward depression force can be applied on the ignition button to compress the piezoelectric unit for generating piezoelectricity and ignite the piezoelectric lighter.

DETAILED DESCRIPTION OF THE PREFERRED EMBODIMENT

Figure 1:
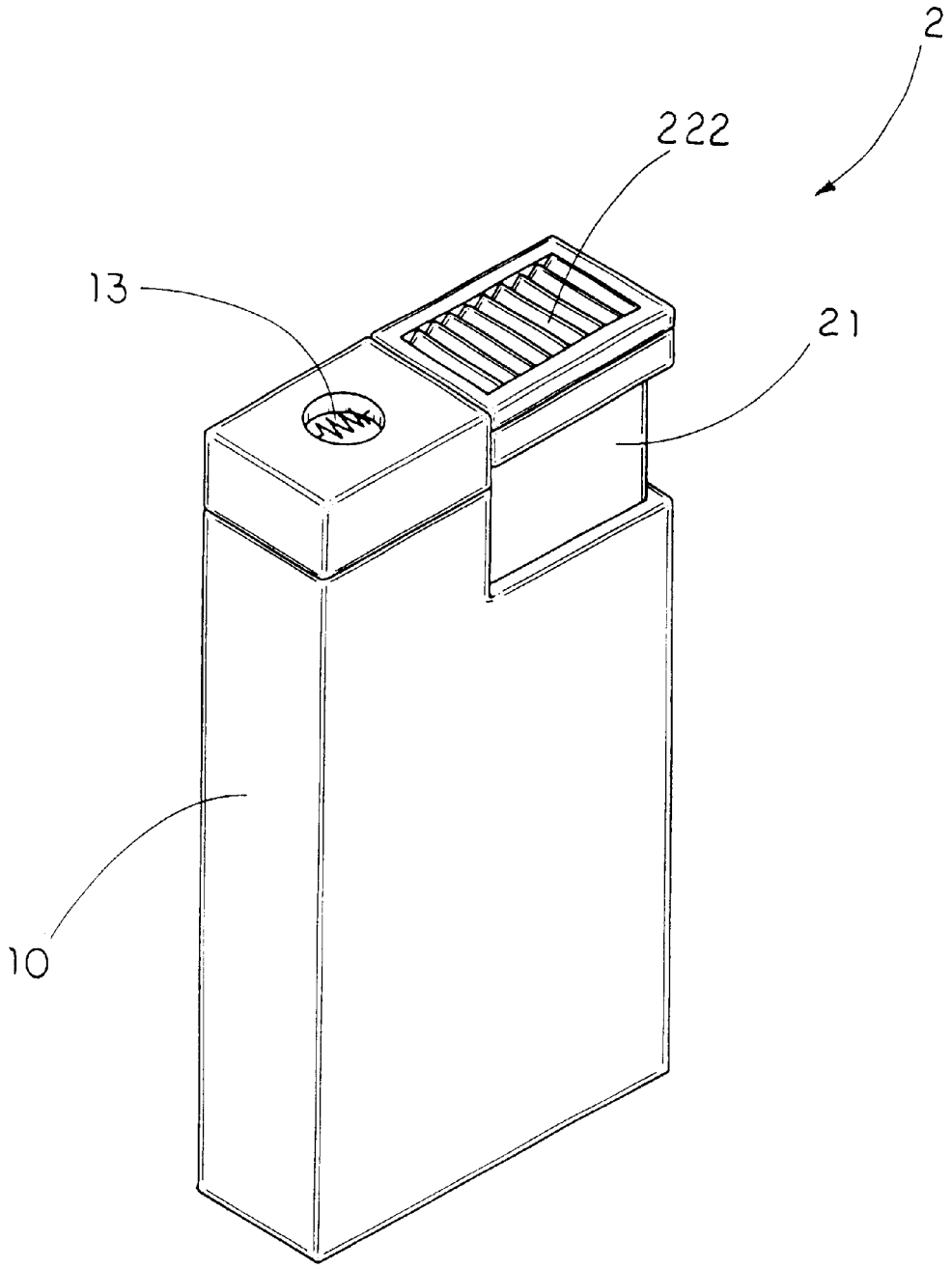
FIG. 1 is a perspective view of a piezoelectric lighter with safety arrangement according to a first preferred embodiment of the present invention.
Figure 2:
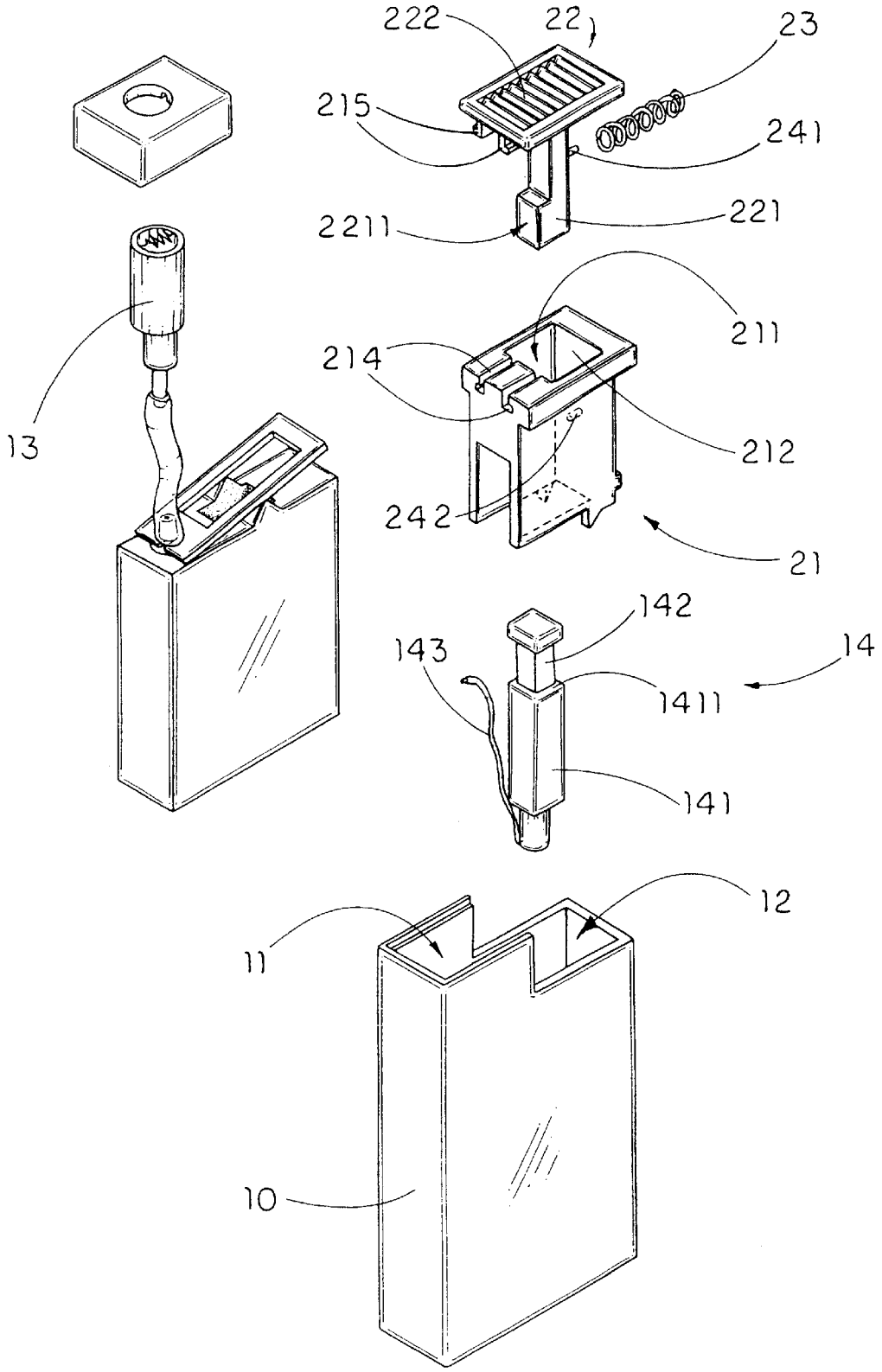
FIG. 2 is an exploded perspective view of the piezoelectric lighter with safety arrangement according to the above first preferred embodiment of the present invention.

Referring to FIGS. 1 and 2 of the drawings, a piezoelectric lighter incorporated with a safety arrangement 2 according to a preferred embodiment of the present invention is illustrated. The piezoelectric lighter, such as a standard piezoelectric lighter, comprises a casing 10 receiving a liquefied storage 11 and an ignition cavity 12 provided therein, a gas emitting nozzle 13 disposed in the casing 10 and communicating with the liquefied gas storage 11 for controlling a flow of gas, a piezoelectric unit 14 disposed in the casing 10 for generating piezoelectricity, and a safety arrangement 2 which comprises an ignition button 21, a locking member 22 for blocking up the ignition button 21 from being depressed downwardly, and a resilient element 23 disposed in the ignition cavity 12 for applying an urging pressure against the locking member 22 so as to retain the locking member 22 in an locking position.

The piezoelectric unit 14 comprises a piezoelectric body 141 having a ceiling 1411 disposed in the casing 10, a movable operating part 142 upwardly extended from the piezoelectric body 141, and an ignition tip 143 extended to a position close to the gas emitting nozzle 13, wherein when the movable operating part 142 is depressed downwardly with respect to the piezoelectric body 141, the ignition tip 143 generates sparks to ignite the gas emitted from the gas emitting nozzle 13 at the same time.

The ignition button 21 is movably mounted on the casing 10 in a vertical movable manner wherein the ignition button 21 is attached to a top end of the movable operating part 142 of the piezoelectric unit 14 and arranged in such a manner that when the ignition button 21 is pushed downwardly, the movable operating part 142 of the piezoelectric unit 14 is depressed to ignite the piezoelectric lighter. Moreover, the ignition button 21 has a guiding slot 211 provided on a top portion thereof to communicate with outside.

The locking member 22 comprises a locking arm 221 disposed in the ignition cavity 12 of the casing 10 and arranged to bias against the ceiling 1411 of the piezoelectric body 141 for blocking up the ignition button 21 from being depressed downwardly so as to lock up the ignition button 21 from ignition and an operation button 222 slidably mounted on the ignition button 21 and is arranged to operate the locking arm 221 to move from a normally locking position to an unlocking position.

Figure 3A:
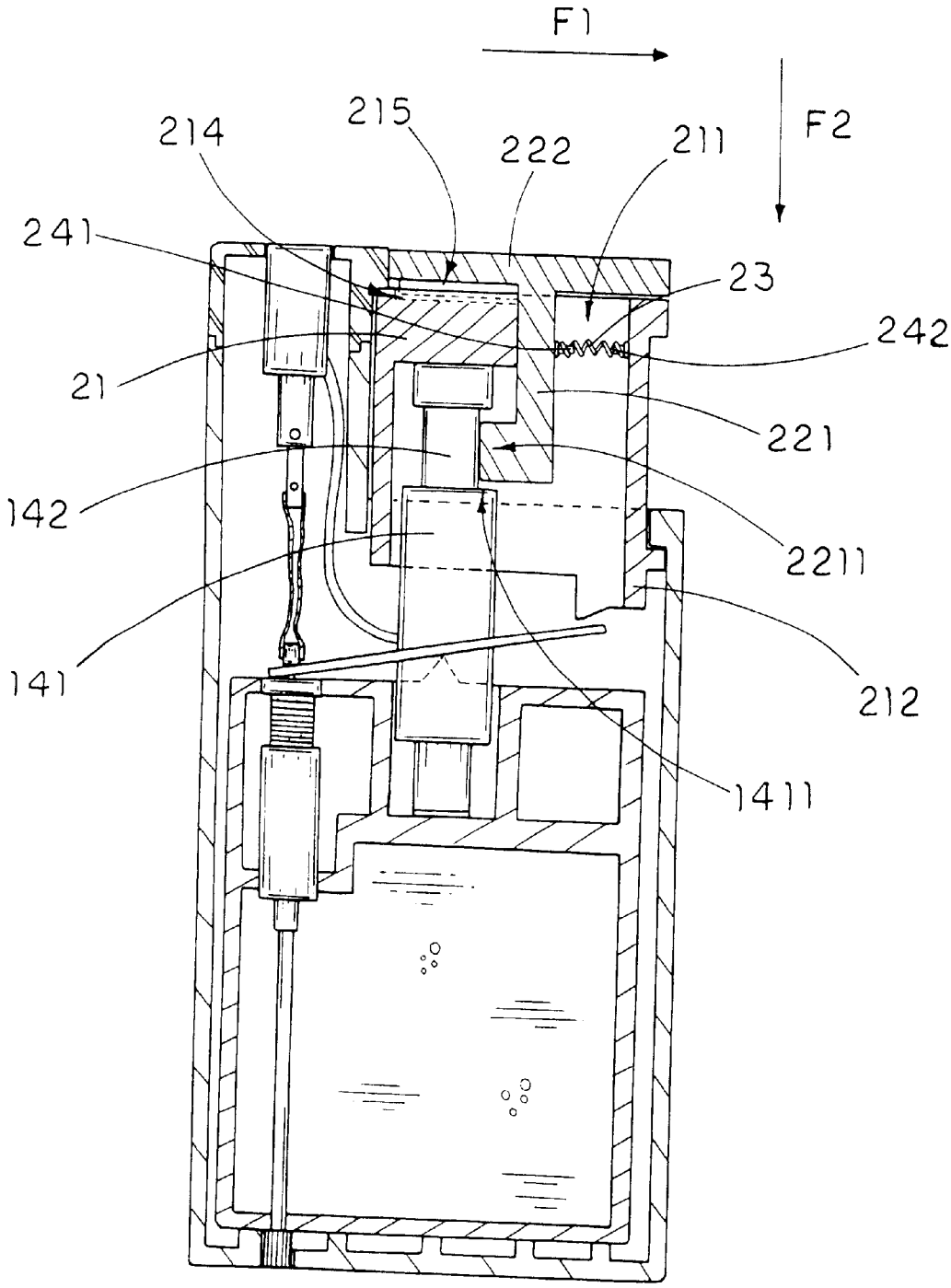
FIG. 3A is a sectional view of the safety arrangement of the piezoelectric lighter in a locking position according to the above first preferred embodiment of the present invention.
Figure 3B:
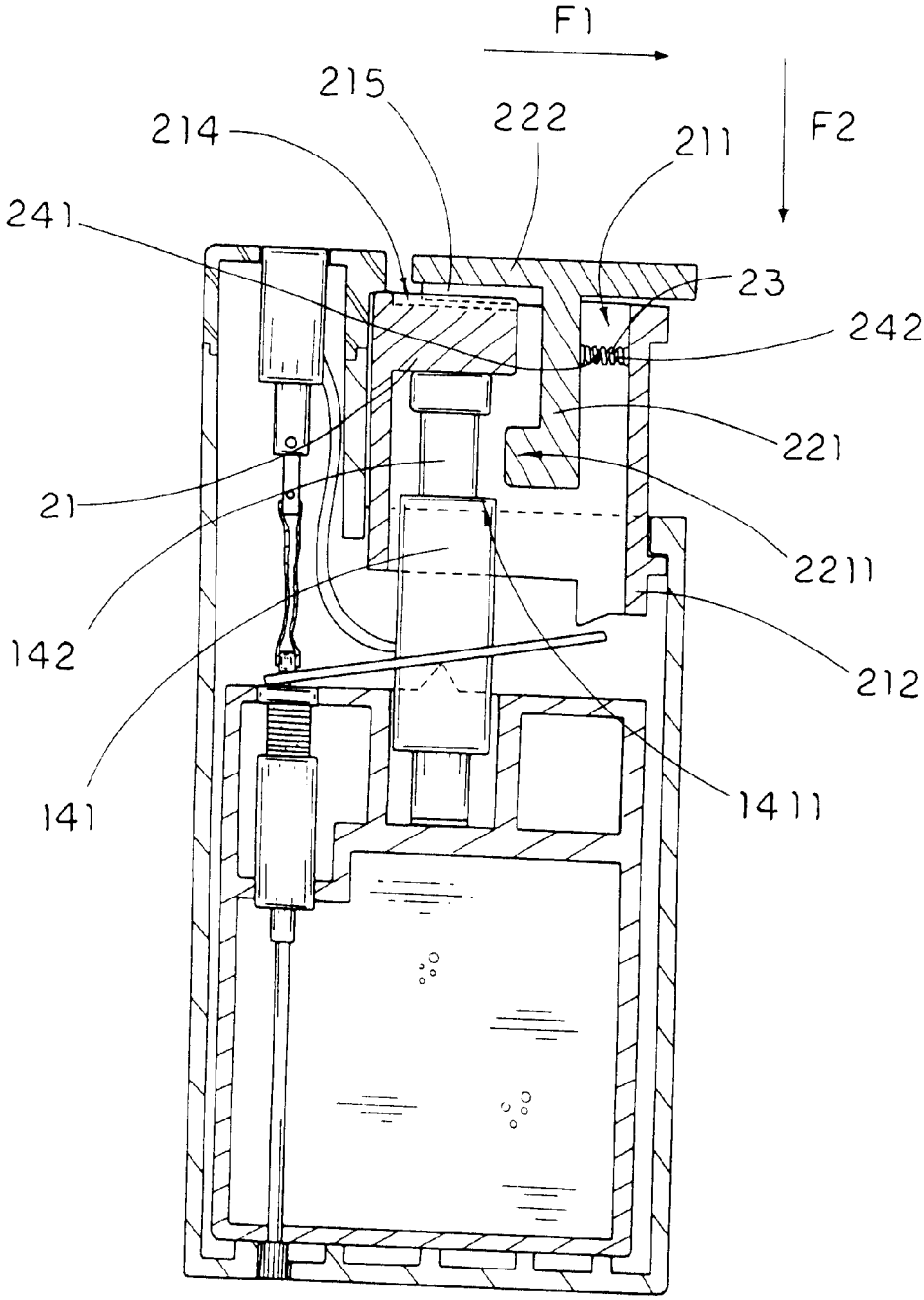
FIG. 3B is a sectional view of the safety arrangement of the piezoelectric lighter in an unlocking position according to the above first preferred embodiment of the present invention.

The resilient element 23 is disposed in the ignition cavity 12 for applying an urging pressure against the locking member 22 so as to normally retain the locking member 22 in the locking position. Accordingly, in the locking position as shown in FIG. 3A, the ignition button 21 is locked for downward movement by the locking member 22 so as to prevent ignition. Moreover, in the unlocking position as shown in FIG. 3B, the locking member 22 is moved to release the blocking up of the ignition button 21 with respect to the piezoelectric unit 14, so that the ignition button 21 is capable of being depressed downwardly to ignition the piezoelectric lighter.

According to the preferred embodiment, the locking arm 221 having a predetermined length is downwardly and integrally extended from the operation button 222 through the guiding slot 211 until a bottom end portion of the locking arm 221 reaches the ceiling 1411 of the piezoelectric body 141 so that the ceiling 1411 of the piezoelectric body 141 of the piezoelectric unit 14 blocks up the downwardly movement of the ignition button 21 to prevent ignition. a shape of the piezoelectric unit 14, so as to not only lock up the downward movement of the ignition button 21 but only block up the depression of the movable operating part 142 of the piezoelectric unit 14 for preventing the piezoelectric lighter from being ignited. The locking arm 221 has a blocking portion 2211 outwardly protruded therefrom to form a L-shape structure, wherein the bottom end of the blocking portion 2211 of the locking arm 221 is arranged to rest on the ceiling 1411 of the piezoelectric body 141 of the piezoelectric unit 14 for locking the ignition button 21 in a downward movable manner and a top edge of the blocking portion 2211 of the locking arm 221 is adapted to bias against an enlarged top portion of the movable operating part 142 of the piezoelectric unit, so as to block up the depression motion of the movable operating part 142 of the piezoelectric unit 14 to ignite the piezoelectric lighter. It is worth to mention that the locking arm 221 will be forced by the resilient element 23 towards to the piezoelectric unit 14 until the locking arm 221 bias against the movable operating part 142 of the piezoelectric unit 14, as shown in FIG. 3A.

The guiding slot 211, which is provided on a top of the ignition button 21, is an elongated through slot that has a length adapted for the locking arm 221 moving from the locking position to the unlocking position.

In order to enhance the sliding movement of the operation button 222 on the ignition button 21, the ignition button 21 has a pair of parallel guiding tracks 214 provided on top of the ignition button 21 and a pair of corresponding opposed L-shaped projections 215 downwardly formed on the operation button 222 and arranged to slidably mounted on the guiding tracks 214 respectively, so as to ensure a sliding movement of the operation button 222 on the ignition button 21.

The resilient element 23, according to the preferred embodiment of the present invention, is a compression spring, which is horizontally disposed in the ignition cavity 12 and is provided between the locking arm 221 and a rear wall 212 of the ignition button 21. The resilient element 23 is biasing against the locking arm 221 and the rear wall 212 of the ignition button 21 by attaching a first end of resilient element 23 to the locking arm 221 and a second end of the resilient element 23 to the rear wall 212 of the ignition button 21. Accordingly, the resilient element 23 will normally urge and retain the locking arm 221 in the locking position that the bottom end of the locking arm 221 is extended to rest on the ceiling 1411 of the piezoelectric body 141 of the piezoelectric unit 14, so as to block up any downward movement of the locking member 22 for blocking up the ignition button 21 from being pushed downwardly, so as to lock up the ignition button 21 from ignition.

Moreover, the safety arrangement 2 of the piezoelectric lighter further comprises a first holder 241 and a second holder 242 for holding the resilient element 23 in position so as to secure the two ends of the resilient element 23 to bias against the locking arm 221 and the rear wall 212 of the ignition button 21. The first and second holders 241, 242 are two rod-like protrusions perpendicularly protruded from the locking arm 221 and the rear wall 212 of the ignition button 21 respectively wherein the first and second holders 241, 242 are adapted to insert into the two ends of the resilient element 23 respectively to securely hold the resilient element 23 between the locking arm 221 and the ignition button 21.

In order to ignite the piezoelectric lighter, a pulling force F1 is intentionally applied to pull the operation button 222 of the locking member 22 rearwardly so as to move the bottom end of the locking arm 221 away from the ceiling 1411 of the piezoelectric body 141 of the piezoelectric unit 14 to unlock the safety arrangement 2. At his unlocked position, a downward depression force F2 can be applied on the ignition button 21 to compress the piezoelectric unit 14 for generating piezoelectricity and ignite the piezoelectric lighter.

While releasing the downward depression force F2 on the ignition button 21, the compressed piezoelectric unit 14 will rebound to its original form which pushes the ignition button 21 back to its original position. Furthermore, the resilient element 23 will then rebound frontwardly and force the locking arm 221 back to its original lock-up position.

Figure 4:
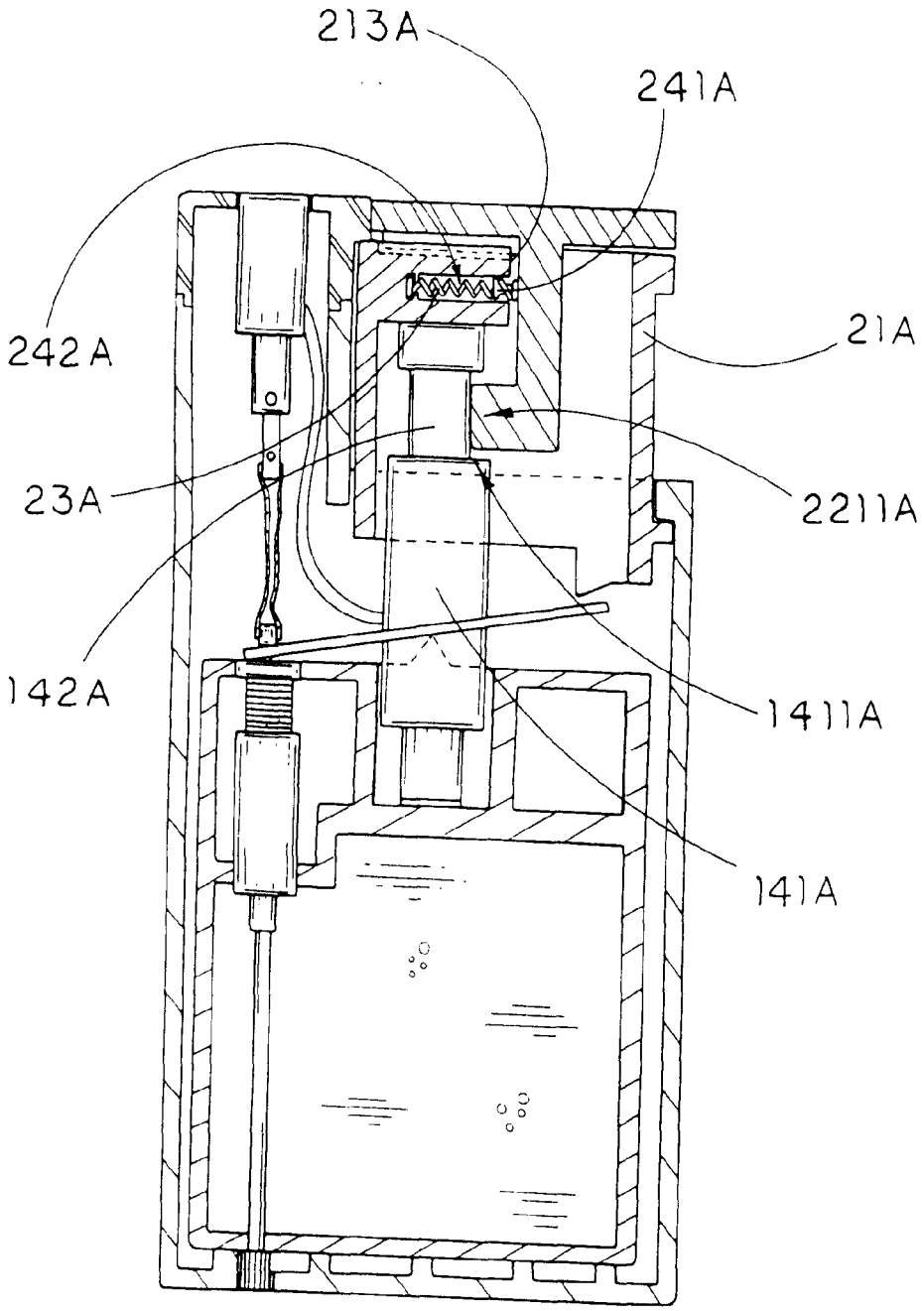
FIG. 4 illustrates a first alternative mode of a resilient element of the safety arrangement of the piezoelectric lighter according to the above first preferred embodiment of the present invention.

FIG. 4 illustrates an alternative mode of the resilient element 23A of the safety arrangement 2A wherein the resilient element 23A is horizontally disposed in the ignition cavity 12A and is provided between the locking arm 221A and a front wall 213A of the ignition button 21A. The resilient element 23A is biasing against the locking arm 221A and the front wall 213A of the ignition button 21A by attaching a first end of resilient element 23A to the locking arm 221A and a second end of the resilient element 23A to the rear wall 212A of the ignition button 21A.

As shown in FIG. 4, the safety arrangement 2A of the piezoelectric lighter further comprises a rod-like protrusion 241A protruded from the locking arm 221A and a spring hole 242A transversely formed on the front wall 213A of the ignition button 21A, wherein the first end of the resilient element 23A is adapted to be inserted into the protrusion 241A and the second end of the resilient element 23A is adapted to insert into the spring hole 242A, so as to secure the two ends of the resilient element 23A to bias against the locking arm 221A and the front wall 213A of the ignition button 21A. Accordingly, the resilient element 23A will pull the locking arm 221A towards the piezoelectric unit 14A that the bottom end of blocking portion 2211A the locking arm 221A will rest on the ceiling 1411A of the piezoelectric body 141A of the piezoelectric unit 14A to prevent ignition.

Figure 5:
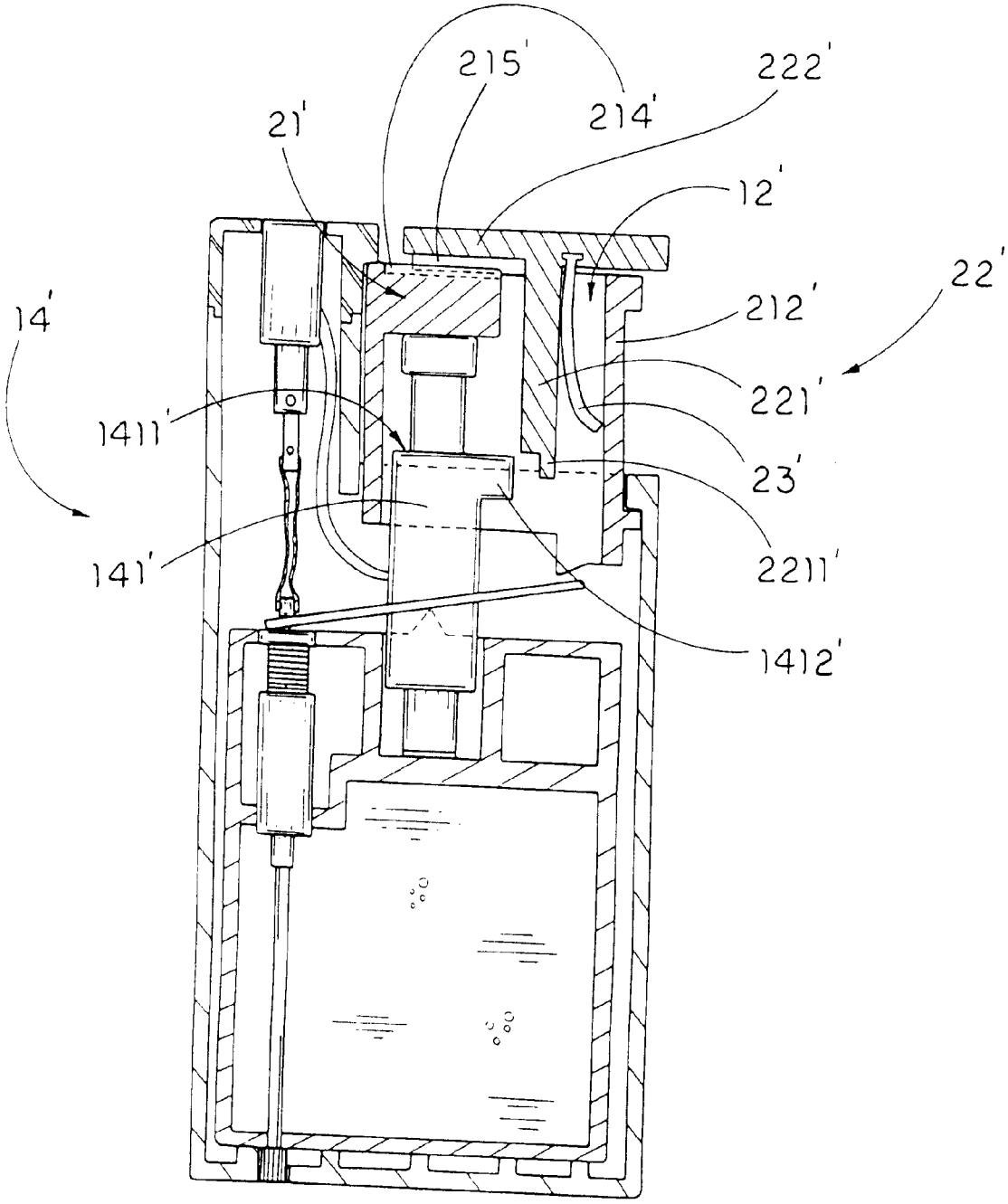
FIG. 5 is a sectional view of a safety arrangement of the piezoelectric lighter in a locking position according to a second preferred embodiment of the present invention.

Referring to FIG. 5, a second embodiment of the present invention illustrates an alternative mode of the safety arrangement 2 of the first embodiment, wherein the structure of the second embodiment is the same as that of the first embodiment, such as the pair of parallel guiding tracks 214' provided on top of the ignition button 21' and a pair of corresponding opposed L-shaped projections 215' downwardly formed on the operation button 222' and arranged to slidably mounted on said guiding tracks 214' respectively.

According to the second embodiment, the piezoelectric unit 14' further comprises a platform 1412' rearwardly extended. from the piezoelectric body 141', so as to enlarge an area of the ceiling 1411' of the piezoelectric body 141', as shown in FIG. 5.

The bottom end of the locking arm 221' of the locking member 22' is normally rest on the platform 1412' for blocking up the downward movement of the ignition button 21', so as to lock up the ignition of the piezoelectric lighter.

The locking arm 221' further comprises a guiding protrusion 2211' downwardly and integrally extended from a rear portion of the bottom end of the locking arm 221' and arranged to bias against a front side of the platform 1412' for blocking up the frontward movement of the locking member 22' towards to the piezoelectric unit 14' so as to ensure the locking position of the locking arm 221', as shown in FIG. 5. When the pulling force F1 is applied on the operation button 222', the bottom end of the locking arm 221' is moved away from the platform 1412' of the piezoelectric body 142' of the piezoelectric unit 14' to unlock the safety arrangement 2', as shown in FIG. 6.

According to the second embodiment, the resilient element 23' is an elongated spring strip vertically disposed in the ignition cavity 12' and provided between the locking arm 221' and the rear wall 212' of the ignition button 21' for biasing against the locking arm 211' and the ignition button 21'. Accordingly, the resilient element 23' has a first end affixed to the locking member 22' and a second end affixed to the rear wall 212' of the ignition such that the resilient element 23' will normally urge and retain the locking arm 221' in the locking position.

Accordingly, the displacement of the locking arm 221' of the second embodiment can be reduced by the platform 1412' extended from the ceiling 1411' of the piezoelectric body 141' of the piezoelectric unit 14' such that the casing 10' of the piezoelectric lighter can be constructed to have a slim shape, so as to reduce the overall size of the piezoelectric lighter. Thus, for ladies, they may easily operate the piezoelectric lighter by pulling the operation button 222' rearwardly to maintain the unlocking position of the safety arrangement 2' so that it is easier for them to press the unlocked ignition button 21' to ignite the piezoelectric lighter.

Figure 6:
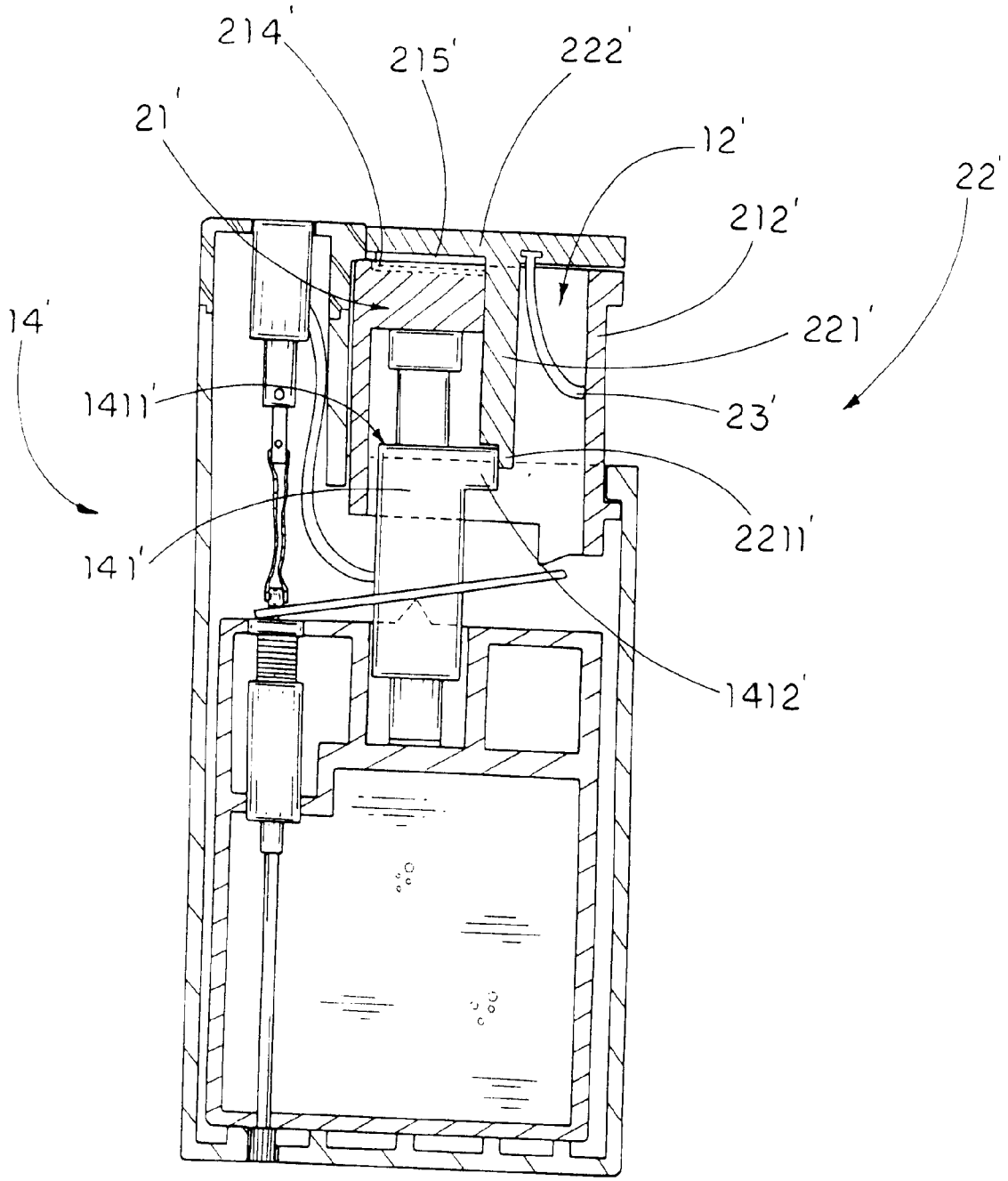
FIG. 6 is a sectional view of a safety arrangement of the piezoelectric lighter in an unlocking position according to the above second preferred embodiment of the present invention.
Figure 7:
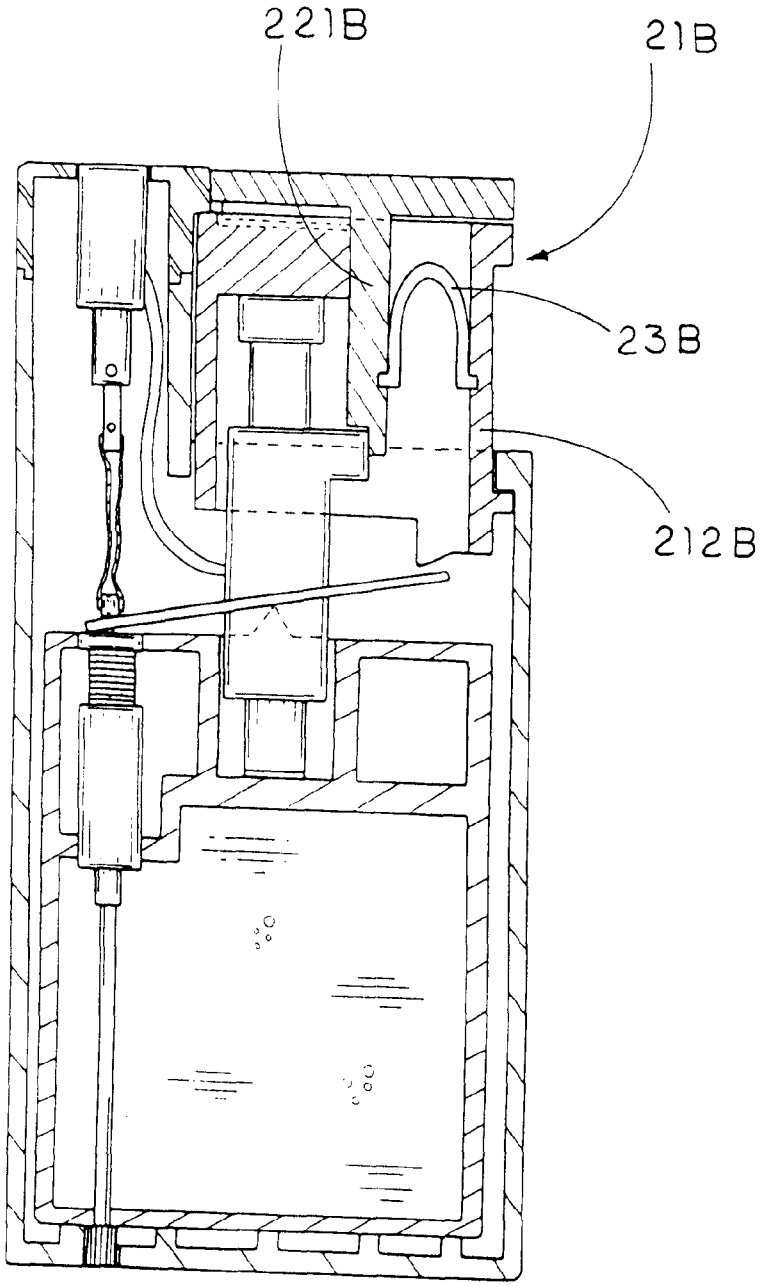
FIG. 7 illustrates an alternative mode of the resilient element of the safety arrangement of the piezoelectric lighter according to the above second preferred embodiment of the present invention.

FIG. 7 illustrates an alternative mode of the resilient element 23B of the safety arrangement 2B of the second embodiment, wherein a U-shaped spring strip is capable of substituting the elongated spring strip as shown in FIGS. 5 and 6 for biasing against the locking arm 221B and the rear wall 212B of the ignition button 21B. The U-shaped spring strap of the resilient element 23B is vertically disposed in the ignition cavity 12B and provided between the locking arm 221B and the rear wall 212B of the ignition button 21B in such a manner that the resilient element 23B will normally urge and retain the locking arm 221B in the locking position.

It is obvious that the compression spring of the resilient element 23, 23A of the first embodiment can be substituted by the elongated spring strap and the U-shaped spring strap of the resilient element 23', 23B for biasing against the locking arm and the ignition button to urge and retain the locking arm in the locking position. In other words, it should be appreciated that certain obvious modifications, variations, and substitutions may be made without departing from the spirit and scope of the present invention while the foregoing description and diagrams describe the preferred embodiments and their alternatives of the present invention, such as the positions of the resilient element and the types of the resilient element.

What is claimed is:

1. A piezoelectric lighter, comprising:

a casing receiving a liquefied gas storage and an ignition cavity provided therein;

a gas emitting nozzle disposed in said casing and communicating with said liquefied gas storage for controlling a flow of gas;

a piezoelectric unit for generating piezoelectricity comprising a piezoelectric body, having a ceiling, disposed in said casing, a movable operating part upwardly extended from said piezoelectric body, and an ignition tip extended to a position close to said gas emitting nozzle, wherein when said movable operating part is depressed downwardly with respect to said piezoelectric body, said ignition tip generates sparks to ignite said gas emitted from said gas emitting nozzle; and a safety arrangement, comprising:

an ignition button movably mounted on said casing in a vertical movable manner wherein said ignition button is attached to a top end of said piezoelectric unit and arranged in such a manner that when said ignition button is pushed downwardly, said movable operating part of said piezoelectric unit is depressed to ignite said piezoelectric lighter, wherein said ignition button has a guiding slot provided on a top portion thereof to communicate with outside;

a locking member comprising a locking arm disposed in said ignition cavity of said casing and arranged to bias against said ceiling of said piezoelectric body for blocking up said ignition button from being depressed downwardly so as to lock up said ignition button from ignition and an operation button slidably mounted on said ignition button and arranged to operate said locking arm to move from a normally locking position to an unlocking position, wherein said locking arm has a blocking portion outwardly protruded therefrom to form a L-shape structure, wherein a bottom end of said blocking portion of said locking arm is arranged to rest on said ceiling of said piezoelectric body of said piezoelectric unit for locking said ignition button in a downward movable manner and a top edge of said blocking portion of said locking arm is adapted to bias against an enlarged top portion of said movable operating part of said piezoelectric unit, so as to block up a depression motion of said movable operating part of said piezoelectric unit to ignite said piezoelectric lighter; and a resilient element which is disposed in said ignition cavity for applying an urging pressure against said locking member so as to normally retain said locking member in said locking position, wherein at said locking position, said ignition button is locked for downward movement by said locking member so as to prevent ignition, and that in said unlocking position, said locking member is moved to release a blocking up of said ignition button with respect to said piezoelectric unit, so that said ignition button is capable of being depressed downwardly to ignite said piezoelectric lighter.

2. The piezoelectric lighter, as recited in claim 1, wherein said locking arm having a predetermined length is downwardly and integrally extended from said operation button through said guiding slot until a bottom end portion of said locking arm reaches said ceiling of said piezoelectric body so that said ceiling of said piezoelectric body of said piezoelectric unit blocks up a downward movement of said ignition button.

3. The piezoelectric lighter, as recited in claim 2, wherein said resilient element is a compression spring horizontally disposed in said ignition cavity and provided between said locking arm and said ignition button for biasing against said locking arm and said ignition button, so as to urge and retain said locking arm in said locking position.

4. The piezoelectric lighter, as recited in claim 3, wherein said safety arrangement further comprises a first holder and a second holder for holding said resilient element in position, wherein said first and second holders are two rod-like protrusion perpendicularly protruded from said locking arm and a rear wall of said ignition button respectively and adapted to insert into two ends of said resilient element respectively, so as to secure two ends of said resilient element to bias against said locking arm and said rear wall of said ignition button.

5. The piezoelectric lighter, as recited in claim 4, wherein said ignition button has a pair of parallel guiding tracks provided on top of said ignition button and a pair of corresponding opposed L-shaped projections downwardly formed on said operation button and arranged to slidably mounted on said guiding tracks respectively, so as to ensure a sliding movement of said operation button on said ignition button.

6. The piezoelectric lighter, as recited in claim 3, wherein said safety arrangement further comprises a first holder and a second holder for holding said resilient element in position, wherein said first holder is a rod-like protrusion protruded from said locking arm and said second holder is a spring hole transversely formed on a front wall of said ignition button such that said first holder is adapted to insert into a first end of said resilient element and a second end thereof is adapted to insert into said spring hole, so as to secure two ends of said resilient element to bias against said locking arm and said front wall of said ignition button.

7. The piezoelectric lighter, as recited in claim 6, wherein said ignition button has a pair of parallel guiding tracks provided on top of said ignition button and a pair of corresponding opposed L-shaped projections downwardly formed on said operation button and arranged to slidably mounted on said guiding tracks respectively, so as to ensure a sliding movement of said operation button on said ignition button.

8. The piezoelectric lighter, as recited in claim 2, wherein said ignition button has a pair of parallel guiding tracks provided on top of said ignition button and a pair of corresponding opposed L-shaped projections downwardly formed on said operation button and arranged to slidably mounted on said guiding tracks respectively, so as to ensure a sliding movement of said operation button on said ignition button.

9. The piezoelectric lighter, as recited in claim 1, wherein said resilient element is a compression spring horizontally disposed in said ignition cavity and provided between said locking arm and said ignition button for biasing against said locking arm and said ignition button, so as to urge and retain said locking arm in said locking position.

10. The piezoelectric lighter, as recited in claim 9, wherein said safety arrangement further comprises a first holder and a second holder for holding said resilient element in position, wherein said first and second holders are two rod-like protrusion perpendicularly protruded from said locking arm and a rear wall of said ignition button respectively and adapted to insert into two ends of said resilient element respectively, so as to secure two ends of said resilient element to bias against said locking arm and said rear wall of said ignition button.

11. The piezoelectric lighter, as recited in claim 9, wherein said safety arrangement further comprises a first holder and a second holder for holding said resilient element in position, wherein said first holder is a rod-like protrusion protruded from said locking arm and said second holder is a spring hole transversely formed on a front wall of said ignition button such that said first holder is adapted to insert into a first end of said resilient element and a second end thereof is adapted to insert into said spring hole, so as to secure two ends of said resilient element to bias against said locking arm and said front wall of said ignition button.

* * * * *